US010755634B2

(12) United States Patent
Hou et al.

(10) Patent No.: US 10,755,634 B2
(45) Date of Patent: Aug. 25, 2020

(54) DISPLAY DRIVING CIRCUIT AND REFRESH RATE ADJUSTMENT METHOD

(71) Applicant: Raydium Semiconductor Corporation, Hsinchu (TW)

(72) Inventors: Chun-Lin Hou, Hsinchu (TW); Shang-Ping Tang, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 16/589,280

(22) Filed: Oct. 1, 2019

(65) Prior Publication Data

US 2020/0111412 A1 Apr. 9, 2020

Related U.S. Application Data

(60) Provisional application No. 62/741,620, filed on Oct. 5, 2018.

(51) Int. Cl.
*G09G 3/36* (2006.01)
*G09G 3/3225* (2016.01)

(52) U.S. Cl.
CPC ..... *G09G 3/3225* (2013.01); *G09G 2330/021* (2013.01)

(58) Field of Classification Search
CPC ... G09G 3/20; G09G 3/36; G09G 3/00; G01R 27/26; G06K 11/06; G08C 21/00
See application file for complete search history.

(56) References Cited

U.S. PATENT DOCUMENTS

2007/0195052 A1* 8/2007 Oh ..... G09G 3/3688 345/100
2008/0143757 A1* 6/2008 Furihata ..... G09G 3/3406 345/690
2014/0267329 A1* 9/2014 Lee ..... G09G 5/18 345/522
2018/0158414 A1* 6/2018 Lee ..... H01L 27/3276

* cited by examiner

*Primary Examiner* — Pegeman Karimi

(57) ABSTRACT

A display driving circuit applied to a display includes a detection unit, a counting unit and an adjusting unit. The detection unit is configured to detect N pulses of an emission control signal of the display in a frame and define a frame porch interval increasing unit accordingly. The frame porch interval increasing unit equals to 1/N frame. N is a positive integer. The counting unit is coupled to the detection unit and configured to count frames according to a first refresh rate. The adjusting unit is coupled to the detection unit and the counting unit and configured to insert M frame porch interval increasing units every time when the counting unit counts L frames to adjust the first refresh rate to a second refresh rate, wherein the second refresh rate is lower than the first refresh rate. L and M are positive integers and L≥M.

14 Claims, 10 Drawing Sheets

DISPLAY DRIVING CIRCUIT AND REFRESH RATE ADJUSTMENT METHOD

BACKGROUND OF THE INVENTION

1. Field of the Invention

The invention relates to a display; in particular, to a display driving circuit and a refresh rate adjustment method.

2. Description of the Prior Art

In general, in order to reduce the power consumption of a display device, conventional methods reduce display power consumption by reducing the display refresh rate.

As shown in FIG. 1, when the refresh rate RR is reduced from the original 60 Hz to 15 Hz, that is to say, the refresh times per second are reduced to ¼ of the original, and during the idle period IP out of the refresh period RP, all display related signals, such as the gate output signal GS and the source output signal SS, can be stopped to save power.

In the application of a self-luminous display, such as an active-matrix organic light-emitting diode (AMOLED) display, the refresh rate can be reduced in different ways.

For example, please refer to FIG. 2. FIG. 2 illustrates a schematic diagram of reducing the refresh rate by using a skip frame method. As shown in FIG. 2, assuming that the refresh rate RR=60 Hz (that is, 16.67 ms) is used as the unit time, when the skip frame method is used, one frame (that is, a refresh frame RF) is refreshed and the next three frames (that is, non-refresh frames SF) are not refreshed, and then periodically repeated, so that the refresh rate RR will be changed from the original 60 Hz divided by 4 to 15 Hz.

The gate output signal GS includes a gate scan signal GSS and an emission control signal ECS. When the refresh rate RR is 15 Hz, the emission control signal ECS maintains normal operation and controls the illumination of the light-emitting diode during one unit time with refreshing, so it is called an emission period EP; the emission control signal ECS stops operating during the three unit times without refreshing, and the light-emitting diode does not emit light, so it is called a non-emission period NEP.

However, for a self-luminous display (e.g., an AMOLED display), once the emission control signal ECS is unable to maintain normal operation such that the light-emitting diode does not emit light during the non-emission period NEP, resulting in changes of the display brightness of the self-luminous display (e.g., the AMOLED display).

If the refresh rate is reduced in the conventional skip frame method, a fixed refresh rate (e.g., 60 Hz, but not limited to this) is usually used as the unit time; one frame is refreshed and the next N frames are not refreshed, and then periodically repeated, and the adjusted refresh rate will be 60 Hz/(1+N), where N is a positive integer. That is, the refresh rate can be obtained only by dividing the unit refresh rate by an integer multiple.

For example, as shown in FIG. 3, it is assumed that the original refresh rate RR=60 Hz, that is, every frame is refreshed, so that every frame is the refresh frame RF. If one frame (e.g., the refresh frame RF) is refreshed and the next frame (e.g., the non-fresh frame SF) is not refreshed, and then periodically repeated, the adjusted refresh rate RR will become 60/(1+1)=30 Hz. If one frame (e.g., the refresh frame RF) is refreshed and the next two frames (e.g., the non-fresh frames SF) are not refreshed, and then periodically repeated, the adjusted refresh rate RR will become 60/(1+2)=20 Hz. If one frame (e.g., the refresh frame RF) is refreshed and the next three frames (e.g., the non-fresh frames SF) are not refreshed, and then periodically repeated, the adjusted refresh rate RR will become 60/(1+3)=15 Hz. The rest can be deduced by analogy and will not be described here.

As shown in FIG. 4, if the refresh rate is reduced by the conventional skip frame method, only the refresh rate by dividing the original refresh rate by an integral can be obtained. For example, if the refresh rate is the maximum unit refresh rate RR(MAX), only the refresh rate obtained by dividing RR(MAX)=60 Hz by an integer, such as ½RR(MAX)=30 Hz, ⅓RR(MAX)=20 Hz, ¼RR(MAX)=15 Hz, ⅕RR(MAX)=12 Hz, can be obtained by using the conventional skip frame method.

In general, the display needs to adopt different refresh rates corresponding to different scenes. For example, the refresh rate should be increased in the continuous dynamic displaying scene, or the refresh rate should be decreased in the power saving scene.

However, as can be seen from the above, if the refresh rate is reduced by the conventional skip frame method, not only the refresh rates other than the maximum unit refresh rate divided by an integral cannot be obtained, but also the entire frame needs to be the smallest unit when the refresh rate is adjusted, which causes many limitations in practical applications and needs to be improved.

SUMMARY OF THE INVENTION

Therefore, the invention provides a display driving circuit and a refresh rate adjustment method to solve the above-mentioned problems occurred in the prior arts.

An embodiment of the invention is a display driving circuit. In this embodiment, the display driving circuit is applied to a display. The display driving circuit includes a detection unit, a counting unit and an adjusting unit. The detection unit is used to detect N pulses of an emission control signal of the display in a frame and define a frame porch interval increasing unit accordingly, wherein the frame porch interval increasing unit equals to 1/N frame, and N is a positive integer. The counting unit is coupled to the detection unit and used to count frames according to a first refresh rate. The adjusting unit is coupled to the detection unit and the counting unit and used to insert M frame porch interval increasing units every time when the counting unit counts L frames to adjust the first refresh rate to a second refresh rate, wherein the second refresh rate is lower than the first refresh rate, and L and M are positive integers and L≥M.

In an embodiment, the display is a self-luminous display.

In an embodiment, the second refresh rate equals to the first refresh rate * [(L*N)/(L*N+M)].

In an embodiment, the plurality of frames all corresponds to a unit time under the first refresh rate.

In an embodiment, under the second refresh rate, the plurality of frames includes adjusted frames adjusted by the adjusting unit and unadjusted frames not adjusted by the adjusting unit; the unadjusted frames correspond to a unit time and the adjusted frames correspond to the unit time plus the frame porch interval increasing unit, and the frame porch interval increasing unit equals to 1/N unit time.

In an embodiment, the M frame porch interval increasing units are inserted into the L frames in equal length of time.

In an embodiment, the M frame porch interval increasing units are inserted into the L frames in different lengths of time.

Another embodiment of the invention is a refresh rate adjustment method. In this embodiment, the refresh rate adjustment method is applied to a display driving circuit of a display. The refresh rate adjustment method includes steps of: (a) detecting N pulses of an emission control signal of the display in a frame and defining a frame porch interval increasing unit accordingly, wherein the frame porch interval increasing unit equals to 1/N frame, and N is a positive integer; (b) counting a plurality of frames according to a first refresh rate; and (c) every time when L frames are counted, inserting M frame porch interval increasing units to the L frames to adjust the first refresh rate to a second refresh rate, wherein the second refresh rate is lower than the first refresh rate, and L and M are positive integers and L≥M.

Compared to the prior art, when the display driving circuit and the refresh rate adjustment method of the invention are applied to a self-illuminating display, in the case where the emission control signal is continuously operated periodically to display the brightness normally, the frame porch interval can be adjusted in the highest operating frequency interval by the flexible frequency switching (FFS) method to obtain arbitrary refresh rates. Therefore, the drawback that the conventional skip frame method can only obtain the refresh rate by dividing the unit refresh rate by an integer should be effectively improved, and the self-luminous display can be more flexible in different refresh rate applications to meet the needs of different display scenarios.

The advantage and spirit of the invention may be understood by the following detailed descriptions together with the appended drawings.

BRIEF DESCRIPTION OF THE APPENDED DRAWINGS

FIG. 6A~FIG. 6I illustrate schematic diagrams showing that the display driving circuit of the invention adjusts to different refresh rates between the maximum refresh rate and the minimum refresh rate respectively.

Figure 7:
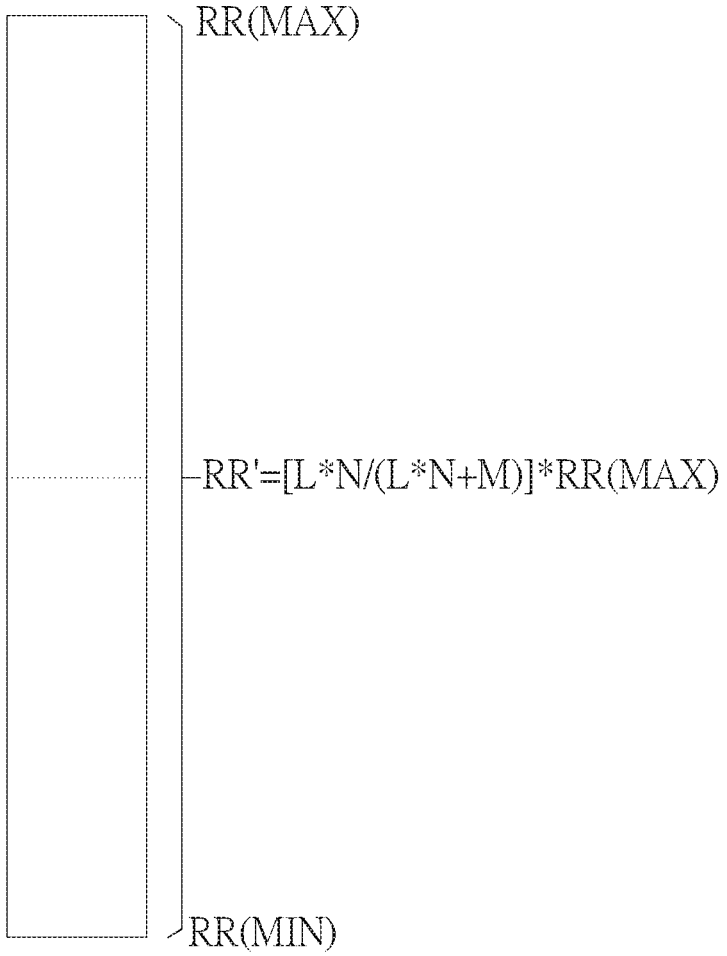

FIG. 7 illustrates a schematic diagram showing that the invention can adjust to an arbitrary refresh rate between the maximum refresh rate and the minimum refresh rate to effectively improve the drawback that only the refresh rate of dividing the unit refresh rate by an integer can be obtained by the conventional skip frame method.

Figure 8:
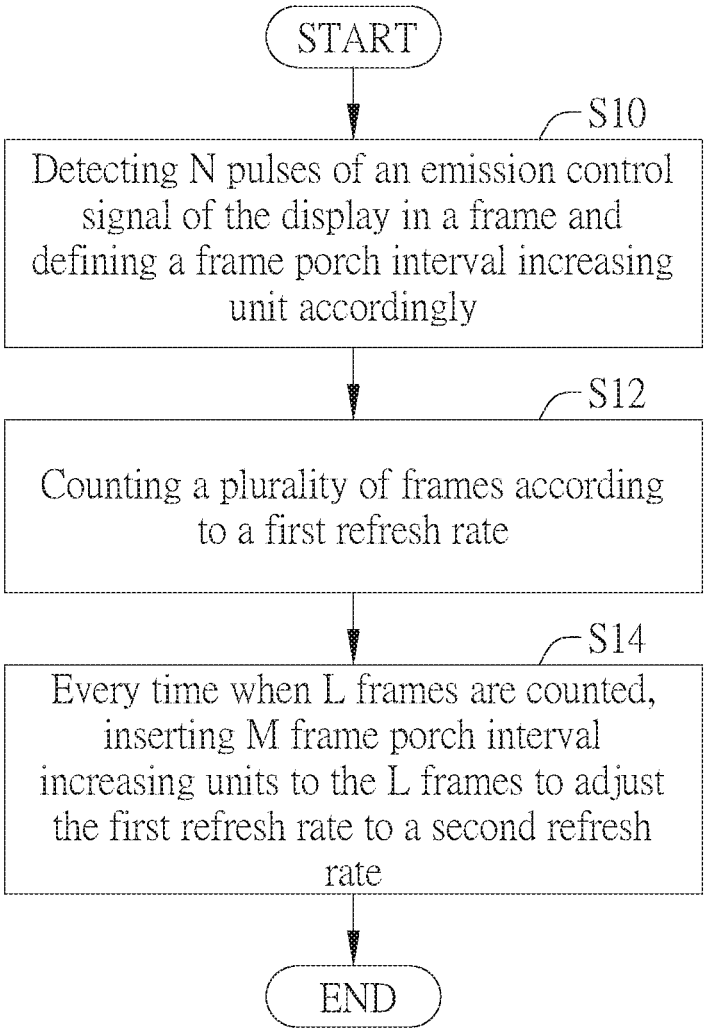

FIG. 8 illustrates a flowchart of the refresh rate adjustment method in another preferred embodiment of the invention.

DETAILED DESCRIPTION OF THE INVENTION

An embodiment of the invention is a display driving circuit. In this embodiment, the display driving circuit can be applied to a self-illuminating display (e.g., an AMOLED display), but not limited to this. When the emission control signal is continuously operated periodically to display the brightness normally, the display driving circuit can adjust the frame porch interval in the highest operating frequency interval by the flexible frequency switching (FFS) method to obtain arbitrary refresh rates, so that the self-luminous display can be more flexible in different refresh rate applications to meet the needs of different display scenarios.

Figure 5:
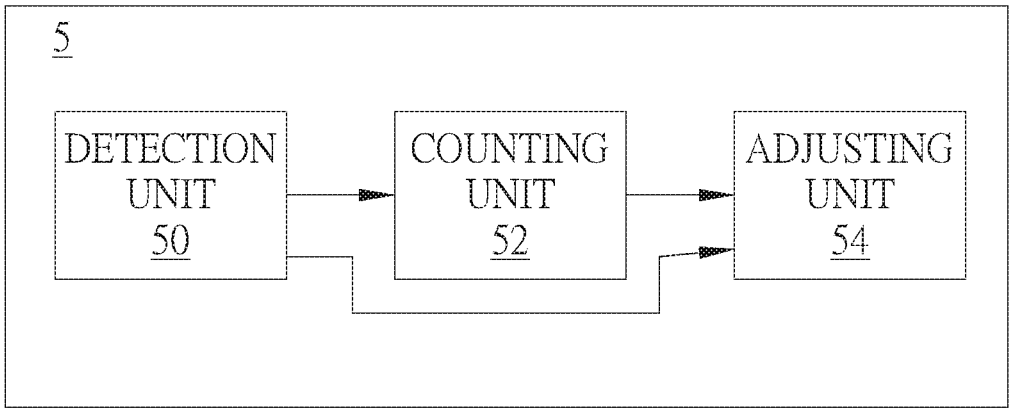
FIG. 5 illustrates a schematic diagram of the display driving circuit in a preferred embodiment of the invention.

Please refer to FIG. 5. FIG. 5 illustrates a schematic diagram of the display driving circuit in this embodiment. As shown in FIG. 5, the display driving circuit 5 can include a detection unit 50, a counting unit 52 and an adjusting unit 54. The detection unit 50 is coupled to the counting unit 52 and the adjusting unit 54 respectively. The counting unit 52 is coupled between the detection unit 50 and the adjusting unit 54.

In general, display related signals of the display can include gate output signals and source output signals, and the gate output signals can include gate scan signals and emission control signals.

In this embodiment, the detection unit 50 is used to detect the number of pulses of an emission control signal in a frame (i.e., a unit time). If the detection unit 50 detects N pulses of the emission control signal in the frame (i.e., the unit time), it can define that a frame porch interval increasing unit equals to 1/N frame (i.e., 1/N unit time) accordingly, wherein N is a positive integer.

It is assumed that the first refresh rate originally used by the display is the maximum unit refresh rate RR(MAX); that is to say, RR (MAX) frames are refreshed within 1 second, and the number of frame porch interval increasing units to be inserted into the RR (MAX) frames is M (M is a positive integer), and the RR (MAX) frames are divided by M to obtain that one frame porch interval increasing unit is inserted every L frames, wherein L is a positive integer.

Then, the counting unit 52 can count the frames (i.e., the unit times) according to the first refresh rate, and the adjusting unit 54 can insert M frame porch interval increasing units every time when the counting unit 52 counts L frames (i.e., L unit times), wherein M is a positive integer and L≥M.

Therefore, a second refresh rate obtained by adjusting the first refresh rate, namely an adjusted refresh rate RR' can be expressed as:

$$RR'=[(L*N)/(L*N+M)]*RR(MAX) \quad \text{(Equation 1)}$$

Figure 6A:
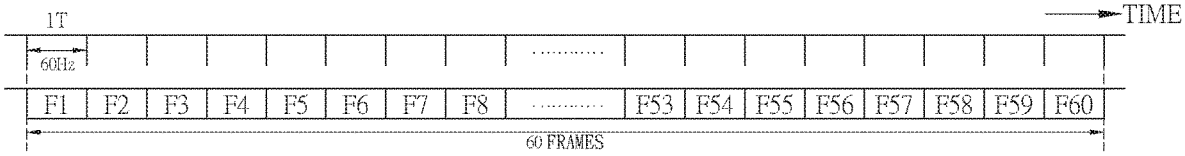

For example, as shown in FIG. 6A, it is assumed that the maximum unit refresh rate RR(MAX)=60 Hz (i.e., the unit time 1 T); that is to say, 60 frames are refreshed within 1 second, and the 60 frames are the first frame F1, the second frame F2, . . . , and the sixtieth frame F60 in order. If the detection unit 50 detects that the emission control signal has 4 pulses in 1 frame (i.e., 1 unit time), namely N=4, it can be defined that the frame porch interval increasing unit is ¼ frame (i.e., ¼ unit time ¼ T).

Figure 1:
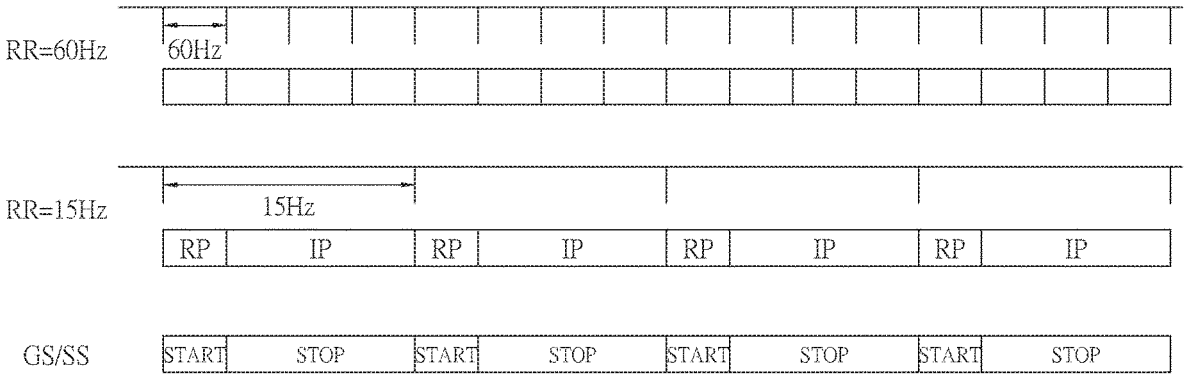
FIG. 1 (PRIOR ART)
FIG. 1 illustrates a schematic diagram showing that when the refresh rate is reduced from 60 Hz to 15 Hz, the gate output signal and the source output signal are stopped during the idle period.
Figure 6B:
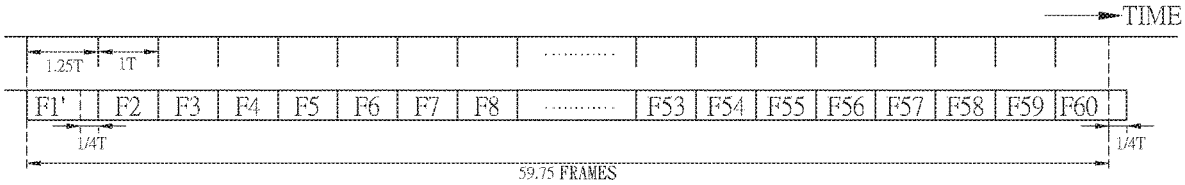

According to FIG. 6A and FIG. 6B, the refresh rate in this embodiment is adjusted downward from the highest operating frequency interval 60 Hz, so that L=60. As shown in FIG. 6B, 1 frame porch interval increasing unit is inserted every 60 frames, so that M=1. If the frame porch interval increasing unit is inserted in the first frame of every 60 frames, when the counting unit 52 counts to the first frame F1, the adjusting unit 54 will insert ¼ frame in the first frame F1 (i.e., ¼ unit time ¼ T), so that the adjusted first frame F1' will become 1.25 frames (i.e., 1.25 unit time 1.25 T), and the second frame F2 to the 60th frame F60 still maintain 1 frame (i.e., 1 unit time 1 T). Therefore, the adjusted refresh rate RR' shown in FIG. 6B will become [(60*4)/(60*4+1)]*60=59.75 Hz; that is to say, 59.75 frames are refreshed in 1 second. It should be noted that 1 frame porch interval increasing unit can be inserted in any frame of the second frame F2 to the 60th frame F60 in the invention, there is no specific limitations.

Figure 2:
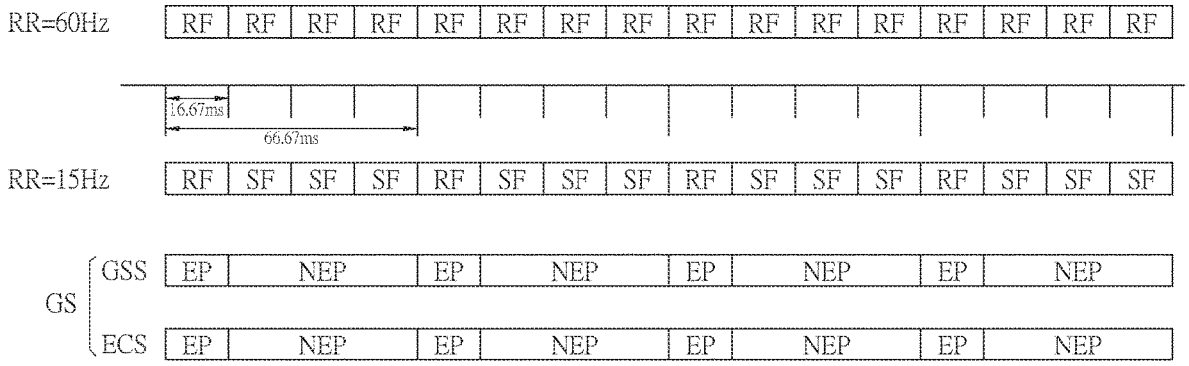
FIG. 2 (PRIOR ART)
FIG. 2 illustrates a schematic diagram of reducing the refresh rate through the conventional skip frame method.
Figure 6C:
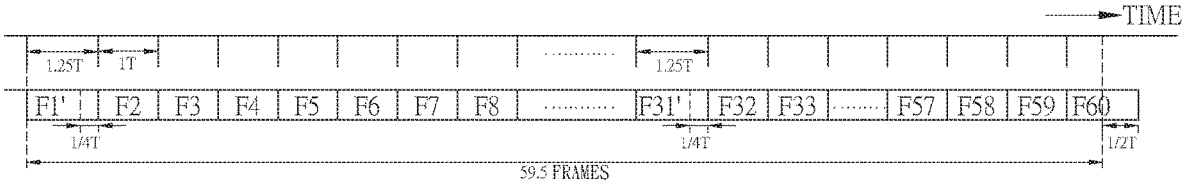

According to FIG. 6A and FIG. 6C, the refresh rate in this embodiment is adjusted downward from the highest operating frequency interval 60 Hz, so that L=60. As shown in FIG. 6C, 2 frame porch interval increasing units are inserted every 60 frames, so that M=2. If one frame porch interval increasing unit is inserted in the first frame of every 30 frames in the equal time inserting way, when the counting unit 52 counts to the first frame F1, the adjusting unit 54 will insert ¼ frames (i.e., ¼ unit time ¼ T) in the first frame F1, so that the adjusted first frame F1' will become 1.25 frames (i.e., 1.25 unit time 1.25 T). Similarly, when the counting unit 52 counts to the 31st frame F31, the adjusting unit 54 will insert ¼ frame (i.e., ¼ unit time ¼ T) in the 31st frame F31, so that the adjusted 31st frame F31' will become 1.25 frames (i.e., 1.25 unit time 1.25 T). The second frame F2 to the 30th frame F30 and the 32nd frame F32 to the 60th frame F60 are still maintained one frame (i.e., 1 unit time 1 T). Therefore, the adjusted refresh rate RR' shown in FIG. 6C will become [(30*4)/(30*4+1)]*60=59.5 Hz; that is to say, 59.5 frames are refreshed in 1 second. It should be noted that 2 frame porch interval increasing units can be inserted every 60 frames not only in the equal time inserting way, but also in the unequal time inserting way.

Figure 3:
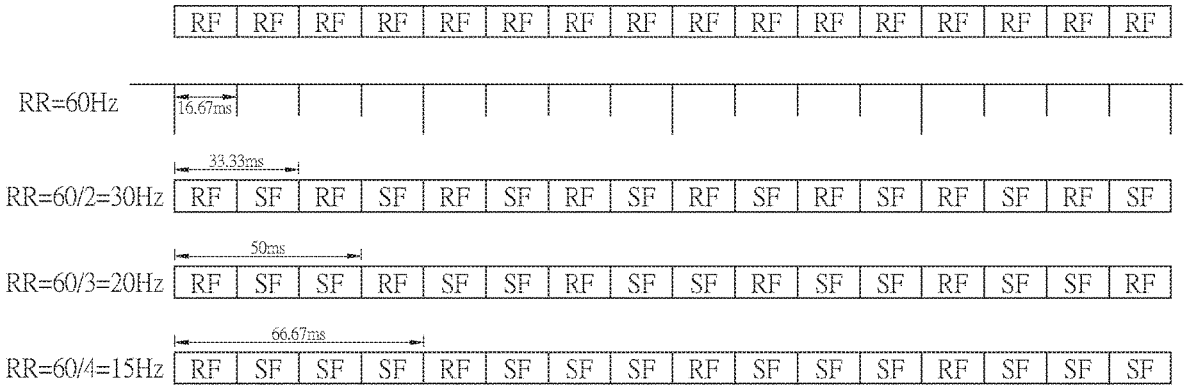
FIG. 3 (PRIOR ART)
FIG. 3 illustrates a schematic diagram showing that if the refresh rate is reduced by the conventional skip frame method, only the refresh rate of dividing the unit refresh rate by an integer can be obtained.
Figure 6D:
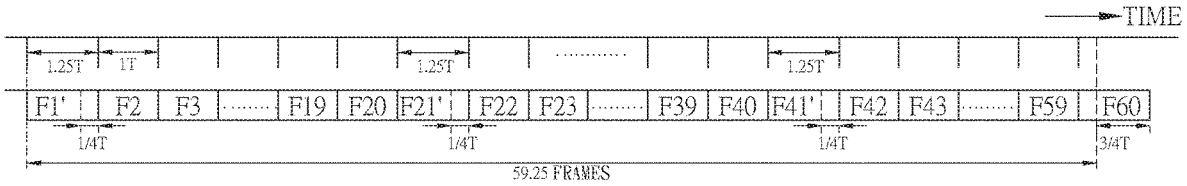

According to FIG. 6A and FIG. 6D, the refresh rate in this embodiment is adjusted downward from the highest operating frequency interval 60 Hz, so that L=60. As shown in FIG. 6D, 3 frame porch interval increasing units are inserted every 60 frames, so that M=3. If one frame porch interval increasing unit is inserted in the first frame of every 30 frames in the equal time inserting way, when the counting unit 52 counts to the first frame F1, the adjusting unit 54 will insert ¼ frames in the first frame F1 (i.e., ¼ unit time ¼ T), so that the adjusted first frame F1' will become 1.25 frames (i.e., 1.25 unit time 1.25 T). Similarly, when the counting unit 52 counts to the 21st frame F21, the adjusting unit 54 will insert ¼ frame (i.e., ¼ unit time ¼ T) in the 21st frame F21, so that the adjusted 21st frame F21' will become 1.25 frames (i.e., 1.25 unit time 1.25 T). When the counting unit 52 counts to the 41st frame F41, the adjusting unit 54 will insert ¼ frame (i.e., ¼ unit time ¼ T) in the 41st frame F41, so that the adjusted 41st frame F41' will become 1.25 frames (i.e., 1.25 unit time 1.25 T). The second frame F2 to the 20th frame F20, the 22nd frame F22 to the 40th frame F40 and the 42nd frame F42 to the 60th frame F60 are still maintained one frame (i.e., 1 unit time 1 T). Therefore, the adjusted refresh rate RR' shown in FIG. 6D will become [(20*4)/(20*4+1)]*60=59.25 Hz; that is to say, 59.25 frames are refreshed in 1 second. It should be noted that 3 frame porch interval increasing units can be inserted every 60 frames not only in the equal time inserting way, but also in the unequal time inserting way.

Figure 4:
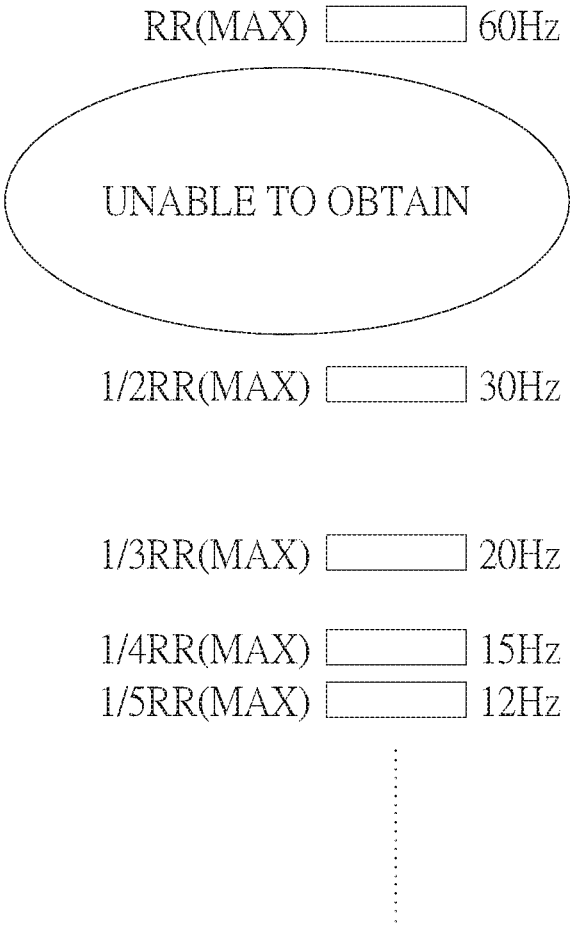
FIG. 4 (PRIOR ART)
FIG. 4 illustrates a schematic diagram showing that if the refresh rate is reduced by the conventional skip frame method, the refresh rate not obtained by dividing the maximum refresh rate by an integer cannot be obtained.
Figure 6E:
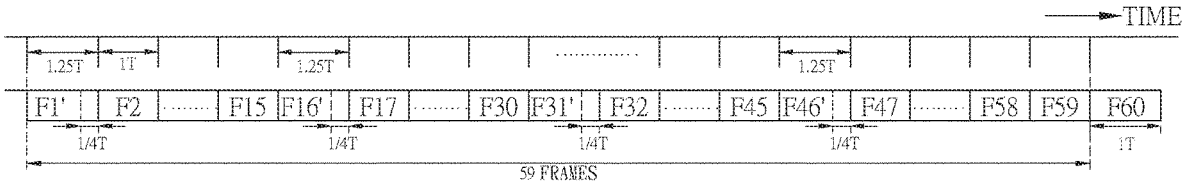

According to FIG. 6A and FIG. 6E, the refresh rate in this embodiment is adjusted downward from the highest operating frequency interval 60 Hz, so that L=60. As shown in FIG. 6E, 4 frame porch interval increasing units are inserted every 60 frames, so that M=4. If one frame porch interval increasing unit is inserted in the first frame of every 15 frames in the equal time inserting way, when the counting unit 52 counts to the first frame F1, the adjusting unit 54 will insert ¼ frames in the first frame F1 (i.e., ¼ unit time ¼ T), so that the adjusted first frame F1' will become 1.25 frames (i.e., 1.25 unit time 1.25 T). Similarly, when the counting unit 52 counts to the 16th frame F16, the adjusting unit 54 will insert ¼ frame (i.e., ¼ unit time ¼ T) in the 16th frame F16, so that the adjusted 16th frame F16' will become 1.25 frames (i.e., 1.25 units of time 1.25 T). When the counting unit 52 counts to the 31st frame F31, the adjusting unit 54 will insert ¼ frame (i.e., ¼ unit time ¼ T) in the 31st frame F31, so that the adjusted 31st frame F31' will become 1.25 frames (i.e., 1.25 unit time 1.25 T). When the counting unit 52 counts to the 46th frame F46, the adjusting unit 54 will insert ¼ frame (i.e., ¼ unit time ¼ T) at the 46th frame F46, so that the adjusted 46th frame F46' will become 1.25 frames (i.e., 1.25 unit time 1.25 T). The second frame F2 to the 15th frame F15, the 17th frame F17 to the 30th frame F30, the 32nd frame F32 to the 45th frame F45 and the 47th frame F47 to the 60th frame F60 are still maintained 1 frame (i.e., 1 unit time 1 T). Therefore, the adjusted refresh rate RR' shown in FIG. 6E becomes [(15*4)/(15*4+1)]*60=59 Hz; that is to say, 59 frames are refreshed within 1 second. It should be noted that 4 frame porch interval increasing units can be inserted every 60 frames not only in the equal time inserting way, but also in the unequal time inserting way.

Figure 6F:
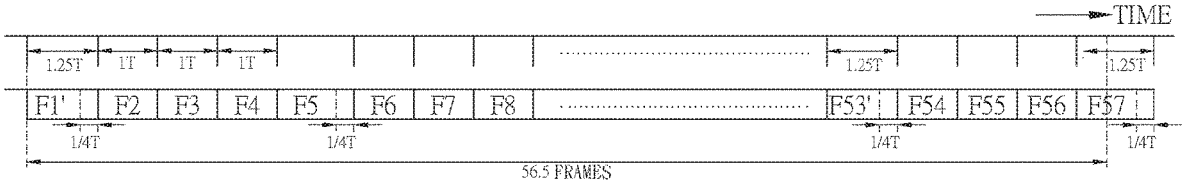

By analogy, according to FIG. 6A and FIG. 6F, the refresh rate in this embodiment is adjusted downward from the highest operating frequency interval 60 Hz, so that L=60. As shown in FIG. 6F, 15 frame porch interval increasing units are inserted every 60 frames, so that M=15. If one frame porch interval increasing unit is inserted in the first frame of every 4 frames in the equal time inserting way, when the counting unit 52 counts to the first frame F1, the adjusting unit 54 will insert ¼ frames (i.e., ¼ unit time ¼ T) in the first frame F1, so that the adjusted first frame F1' will become 1.25 frames (i.e., 1.25 unit time 1.25 T). Similarly, when the counting unit 52 counts to the fifth frame F5, the adjusting unit 54 will insert ¼ frame (i.e., ¼ unit time ¼ T) in the fifth frame F5, so that the adjusted fifth frame F5' will become 1.25 frames (i.e., 1.25 unit time 1.25 T). Similarly, when the counting unit 52 counts to the 53rd frame F53, the adjusting unit 54 will insert ¼ frame (i.e., ¼ unit time ¼ T) in the 53rd frame F53, so that the adjusted 53rd frame F53' will become 1.25 frames (i.e., 1.25 unit time 1.25 T). When the counting unit 52 counts to the 57th frame F57, the adjusting unit 54 will insert ¼ frame (i.e., ¼ unit time ¼ T) at the 57th frame F57, so that the adjusted 57th frame F57' will become 1.25 frames (i.e., 1.25 unit time 1.25 T). The second frame F2 to the fourth frame F4, the sixth frame F6 to the eighth frame F8, . . . , the 54th frame F54 to the 56th frame F56 and the 58th frame F58 to the 60th frame F60 are still maintained 1 frame (i.e., 1 unit time 1 T). Therefore, the adjusted refresh rate RR' shown in FIG. 6F will become [(4*4)/(4*4+1)]*60=56.5 Hz; that is to say, 56.5 frames are refreshed within 1 second. It should be noted that 15 frame porch interval increasing units can be inserted every 60 frames not only in the equal time inserting way, but also in the unequal time inserting way.

Figure 6G:
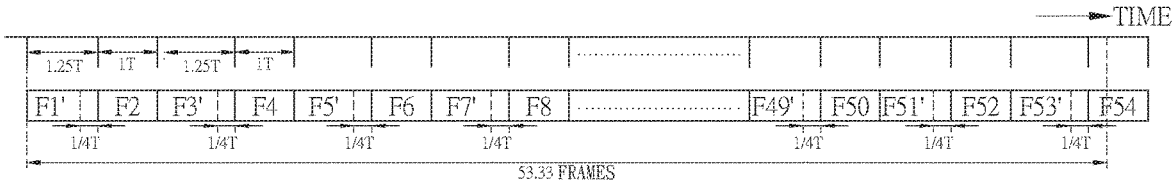

By analogy, according to FIG. 6A and FIG. 6G, the refresh rate in this embodiment is adjusted downward from the highest operating frequency interval 60 Hz, so that L=60. As shown in FIG. 6G, 30 frame porch interval increasing units are inserted every 60 frames, so that M=30. If one frame porch interval increasing unit is inserted in the first frame of every 2 frames in the equal time inserting way, when the counting unit 52 counts to the first frame F1, the adjusting unit 54 will insert ¼ frames (i.e., ¼ unit time ¼ T) in the first frame F1, so that the adjusted first frame F1' will become 1.25 frames (i.e., 1.25 unit time 1.25 T). Similarly, when the counting unit 52 counts to the third frame F3, the adjusting unit 54 will insert ¼ frame (i.e., ¼ unit time ¼ T) in the third frame F3, so that the adjusted third frame F3' will become 1.25 frames (i.e., 1.25 unit time 1.25 T). When the counting unit 52 counts to the fifth frame F5, the adjusting unit 54 will insert ¼ frame (i.e., ¼ unit time ¼ T) in the fifth frame F5, so that the adjusted fifth frame F5' will become 1.25 frames (i.e., 1.25 unit time 1.25 T). Similarly, when the counting unit 52 counts to the 53rd frame F53, the adjusting unit 54 will insert ¼ frame (i.e., ¼ unit time ¼ T) in the 53rd frame F53, so that the adjusted 53rd frame F53' will become 1.25 frames (i.e., 1.25 unit time 1.25 T). The rest can be deduced by analogy. The second frame F2, the fourth frame F4, the sixth frame F6, the eighth frame F8, . . . , the 58th frame F58 and the 60th frame F60 are maintained 1 frame (i.e., 1 unit time 1 T). Therefore, the adjusted refresh rate RR' shown in FIG. 6G will become [(2*4)/(2*4+1)]*60=53.33 Hz; that is to say, 53.33 frames are refreshed within 1 second. It should be noted that 30 frame porch interval increasing units can be inserted every 60 frames not only in the equal time inserting way, but also in the unequal time inserting way.

Figure 6H:
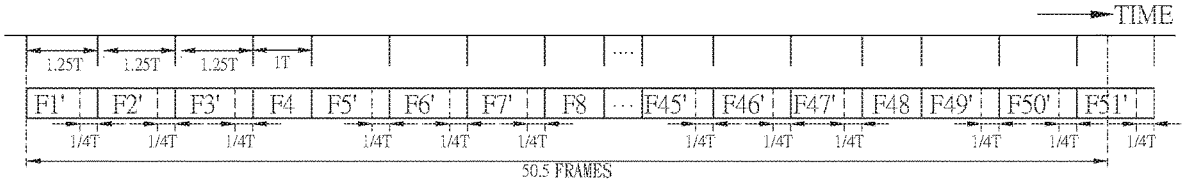

By analogy, according to FIG. 6A and FIG. 6H, the refresh rate in this embodiment is adjusted downward from the highest operating frequency interval 60 Hz, so that L=60. As shown in FIG. 6H, 45 frame porch interval increasing units are inserted every 60 frames, so that M=45. If one frame porch interval increasing unit is inserted in the first frame, the second frame and the third frame of every 4 frames respectively, when the counting unit 52 counts to the first frame F1 to the third frame F3, the adjusting unit 54 will respectively insert ¼ frame (i.e., ¼ unit time ¼ T) in the first frame F1 to the third frame F3 respectively, so that the adjusted first frame F1'~the adjusted third frame F3' are all changed to 1.25 frames (i.e., 1.25 unit time 1.25 T). Similarly, when the counting unit 52 counts to the fifth frame F5 to the seventh frame F7, the adjusting unit 54 will insert ¼ frames (i.e., ¼ unit time ¼ T) in the fifth frame F5 to the seventh frame F7 respectively, so that the adjusted fifth frame F5'~7th frame F7' will become 1.25 frames (i.e., 1.25 unit time 1.25 T). The rest can be deduced by analogy. The fourth frame F4, the eighth frame F8, . . . , the 56th frame F56 and the 60th frame F60 are still maintained 1 frame (i.e., 1 unit time 1 T). Therefore, the adjusted refresh rate RR' shown in FIG. 6H will become {[(4/3)*4]/[(4/3)*4+1]}*60=50.5 Hz; that is to say, 50.5 frames will be refreshed in 1 second. It should be noted that 45 frame porch interval increasing units can be inserted every 60 frames not only in the equal time inserting way, but also in the unequal time inserting way.

Figure 6I:
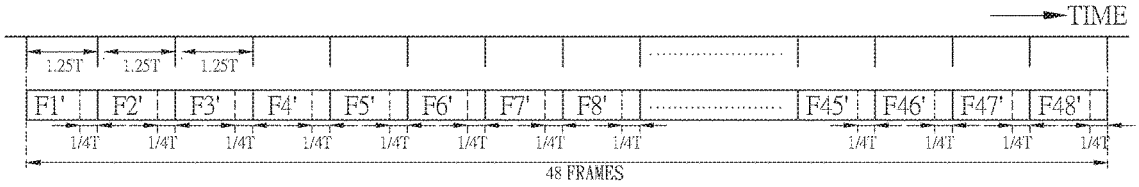

By analogy, according to FIG. 6A and FIG. 6I, the refresh rate in this embodiment is adjusted downward from the highest operating frequency interval 60 Hz, so that L=60. As shown in FIG. 6I, 60 frame porch interval increasing units are inserted every 60 frames, so that M=60. Therefore, one frame is inserted per frame to increase the unit along the interval. When the counting unit 52 counts to the first frame F1 to the 60th frame F60, the adjusting unit 54 will insert ¼ frames (i.e., ¼ unit time ¼ T) from the first frame F1 to the 60th frame F60 respectively. Therefore, the adjusted first frame F1'~60th frame F60' are all changed to 1.25 frames (i.e., 1.25 unit time 1.25 T). Therefore, the adjusted refresh rate RR' shown in FIG. 6I will become [(1*4)/(1*4+1)]*60=48 Hz; that is to say, 48 frames are refreshed in 1 second.

In summary, as shown in FIG. 7, assuming that the first refresh rate is the maximum unit refresh rate RR(MAX), the display driving circuit 5 of the invention can adjust the first refresh rate to a second refresh rate according to Equation 1, that is, the adjusted refresh rate RR'=[(L*N)/(L*N+M)]*RR (MAX), and the adjusted refresh rate RR' can be any refresh rate between the maximum unit refresh rate RR (MAX) and the minimum unit refresh rate RR (MIN).

By doing so, the display driving circuit of the invention can not only effectively improve the drawback that the conventional skip frame method can only obtain the refresh rate by dividing the unit refresh rate with an integer, but also make the self-luminous display more flexible in the applications of different refresh rates to meet the needs of different display scenarios.

Another embodiment of the invention is a refresh rate adjustment method. In this embodiment, the refresh rate adjustment method is applied to a display driving circuit of a self-luminous display, and the self-luminous display can be an AMOLED display, but not limited to this.

Please refer to FIG. 8. FIG. 8 illustrates a flowchart of the refresh rate adjustment method in this embodiment. As shown in FIG. 8, it is assumed that a first refresh rate originally used by the display is the maximum unit refresh rate RR(MAX), namely RR(MAX) frames will be refreshed in 1 second. The refresh rate adjustment method includes following steps of:

S10: detecting N pulses of an emission control signal of the display in 1 frame (i.e., 1 unit time) and defining that a frame porch interval increasing unit equals to 1/N frame (i.e., 1/N unit time) accordingly, wherein N is a positive integer;

S12: counting a plurality of frames (i.e., a plurality of unit times) according to the first refresh rate (i.e., the maximum unit refresh rate RR(MAX)); and S14: every time when L frames (i.e., L unit times) are counted by the step S12, inserting M frame porch interval increasing units to the L frames to adjust the first refresh rate to the second refresh rate, wherein the second refresh rate is lower than the first refresh rate, and L>0.

Therefore, when the RR (MAX) frames are counted, M frame porch interval increasing units are inserted, and M=RR(MAX)/L, where M is a positive integer. The second refresh rate obtained after the above steps S10 to S14 will be the adjusted refresh rate RR'=[(L*N)/(L*N+M)]*RR (MAX).

For a detailed description of the refresh rate adjustment method, please refer to the text description and the drawings of the above embodiments, and no further details are provided herein.

Compared to the prior art, when the display driving circuit and the refresh rate adjustment method of the invention are applied to a self-illuminating display, in the case where the emission control signal is continuously operated periodically to display the brightness normally, the frame porch interval can be adjusted in the highest operating frequency interval by the flexible frequency switching (FFS) method to obtain arbitrary refresh rates. Therefore, the drawback that the conventional skip frame method can only obtain the refresh rate by dividing the unit refresh rate by an integer should be effectively improved, and the self-luminous display can be more flexible in different refresh rate applications to meet the needs of different display scenarios.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display driving circuit, applied to a display, the display driving circuit comprising:

a detection unit, configured to detect N pulses of an emission control signal of the display in a frame and define a frame porch interval increasing unit accordingly, wherein the frame porch interval increasing unit equals to 1/N frame, and N is a positive integer;

a counting unit, coupled to the detection unit and configured to count a plurality of frames according to a first refresh rate; and an adjusting unit, coupled to the detection unit and the counting unit and configured to insert M frame porch interval increasing units every time when the counting unit counts L frames to adjust the first refresh rate to a second refresh rate, wherein the second refresh rate is lower than the first refresh rate, and L and M are positive integers and L≥M.

2. The display driving circuit of claim 1, wherein the display is a self-luminous display.

3. The display driving circuit of claim 1, wherein the second refresh rate equals to the first refresh rate *[(L*N)/(L*N+M)].

4. The display driving circuit of claim 1, wherein the plurality of frames all corresponds to a unit time under the first refresh rate.

5. The display driving circuit of claim 1, wherein under the second refresh rate, the plurality of frames comprises adjusted frames adjusted by the adjusting unit and unadjusted frames not adjusted by the adjusting unit; the unadjusted frames correspond to a unit time and the adjusted frames correspond to the unit time plus the frame porch interval increasing unit, and the frame porch interval increasing unit equals to 1/N unit time.

6. The display driving circuit of claim 1, wherein the M frame porch interval increasing units are inserted into the L frames in equal length of time.

7. The display driving circuit of claim 1, wherein the M frame porch interval increasing units are inserted into the L frames in different lengths of time.

8. A refresh rate adjustment method, applied to a display driving circuit of a display, the refresh rate adjustment method comprising steps of:

(a) detecting N pulses of an emission control signal of the display in a frame and defining a frame porch interval increasing unit accordingly, wherein the frame porch interval increasing unit equals to 1/N frame, and N is a positive integer;

(b) counting a plurality of frames according to a first refresh rate; and (c) every time when L frames are counted, inserting M frame porch interval increasing units to the L frames to adjust the first refresh rate to a second refresh rate, wherein the second refresh rate is lower than the first refresh rate, and L and M are positive integers and L≥M.

9. The refresh rate adjustment method of claim 8, wherein the display is a self-luminous display.

10. The refresh rate adjustment method of claim 8, wherein the second refresh rate equals to the first refresh rate *[(L*N)/(L*N+M)].

11. The refresh rate adjustment method of claim 8, wherein the plurality of frames all corresponds to a unit time under the first refresh rate.

12. The refresh rate adjustment method of claim 8, wherein under the second refresh rate, the plurality of frames comprises adjusted frames adjusted by the step (c) and unadjusted frames not adjusted by the step (c); the unadjusted frames correspond to a unit time and the adjusted frames correspond to the unit time plus the frame porch interval increasing unit, and the frame porch interval increasing unit equals to 1/N unit time.

13. The refresh rate adjustment method of claim 8, wherein the M frame porch interval increasing units are inserted into the L frames in equal length of time.

14. The refresh rate adjustment method of claim 8, wherein the M frame porch interval increasing units are inserted into the L frames in different lengths of time.

* * * * *